US009672718B2

(12) United States Patent
Shilts et al.

(10) Patent No.: US 9,672,718 B2
(45) **Date of Patent: *Jun. 6, 2017**

(54) NESTABLE ANTI-LIGATIVE BED LINEN SYSTEM AND DEVICE

(71) Applicants: Steven J Shilts, San Diego, CA (US); Brook Hjelm, Ramona, CA (US)

(72) Inventors: Steven J Shilts, San Diego, CA (US); Brook Hjelm, Ramona, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/675,411

(22) Filed: Mar. 31, 2015

(65) Prior Publication Data

US 2015/0305524 A1 Oct. 29, 2015

Related U.S. Application Data

(63) Continuation-in-part of application No. 13/834,626, filed on Mar. 15, 2013, now Pat. No. 9,024,773.

(51) Int. Cl.

| | |
|---|---|
| ***G08B 21/00*** | (2006.01) |
| ***G08B 21/18*** | (2006.01) |
| ***A47G 9/10*** | (2006.01) |
| ***A47G 9/02*** | (2006.01) |
| ***A47C 21/02*** | (2006.01) |
| ***A47C 31/10*** | (2006.01) |

(52) U.S. Cl.

CPC ..... *G08B 21/18* (2013.01); *A47C 21/022* (2013.01); *A47C 31/105* (2013.01); *A47G 9/02* (2013.01); *A47G 9/10* (2013.01)

(58) Field of Classification Search

CPC ..... G08B 21/18; A47G 9/0223; A47G 9/0238

USPC ..... 340/686.6, 506, 540, 573.1; 5/482, 498

See application file for complete search history.

(56) References Cited

U.S. PATENT DOCUMENTS

| | | | | |
|---|---|---|---|---|
| 4,266,308 | A * | 5/1981 | Shatz | A47G 9/02 5/494 |
| 4,388,738 | A * | 6/1983 | Wagner | A47C 31/105 5/421 |
| 4,924,543 | A * | 5/1990 | Hoss | A47G 9/02 5/421 |
| 7,810,184 | B2 * | 10/2010 | McCollum | A47G 9/02 5/482 |
| 2010/0306920 | A1 * | 12/2010 | Balasundharam | A47G 9/0238 5/496 |

* cited by examiner

*Primary Examiner* — Phung Nguyen
(74) *Attorney, Agent, or Firm* — Mandy L. Tran; Ceres Patent & Technology LLC

(57) ABSTRACT

A nestable anti-ligative bed linen device and system comprising individual bed linen units wherein a plurality of such units may nest therein and be securely positioned in place on a mattress. Said individual bed linen unit of this system comprising a blanket attached to a cover sheet at a point of union at their common ends. Said union positioned towards the edge of said common ends to allow space for nesting. Said union positioned underneath a mattress by a given distance to allow multiple bed linen units to securely position on a mattress in nested form. The anti-ligative features include a union positioned at a location on said bed linen unit to prevent a lanyard from being formed. Other anti-ligative features include quilted thick tear resistant material and a built in pillow. Additional safety mechanisms are included such as a motion sensor and alarm.

10 Claims, 13 Drawing Sheets

NESTABLE ANTI-LIGATIVE BED LINEN SYSTEM AND DEVICE

CROSS REFERENCE

This continuation in part utility patent application claims benefit of and incorporates by reference in its entirety, U.S. Pat. No. 9,024,773.

FEDERALLY SPONSORED RESEARCH OR DEVELOPMENT

This work was supported by the U.S. Department of Veterans Affairs, and the Federal Government has certain rights in this invention.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

Field of the Invention

The present matter relates to a nestable anti-ligative bed linen system and device.

Background

Annually, there are over 30,000 deaths due to suicide in the United States. More than 90 percent of people who commit suicide have a diagnosable mental disorder, most commonly a depressive disorder or a substance abuse disorder. Bedding and bed sheets are the number one item used to fashion a lanyard for hanging. Bedding and bed sheets are used in 53% of all inpatient suicide completions and attempts. Therefore, there is a need to provide an attractive and safe alternative to the standard bed linens and sheets that hospitals and institutions use.

To reduce the ability to form a lanyard from bed linen, the bed linen should be difficult to remove from the bed, including the sheets and any blankets. Therefore, using a one-piece blanket and mattress cover would be safer as it would be more cumbersome to remove from a bed than individual sheets or blankets. Even better, the bed linens should incorporate an alarm to warn staff that bed linens are being removed. Also, pillow cases create additional suffocation risks and should not be provided to suicidal patients. Therefore, a bed linen system is needed that incorporates a washable pillow that avoids the need for a pillowcase.

The device and system must not only be safe for the particular concern addressed herein but must be practical and functional for the individuals involved. Application of this device and system typically involve the patient, caregiver and institution. As such, the functional concerns of this device must explore the particular needs of each group of individuals who interface with the device and relate back to the heart and purpose of this invention.

As it regards a patient who suffers from self-harming or suicidal behavior and thoughts, the primary concern is to avoid opportunity for which a lanyard may be formed from multiple sheets of bed linen. The comfort and care of the patient is another concern where use of the device must require minimum effort for individuals who have difficulty in movement or motivation. The device must additionally serve its purpose and function effectively. In this case, the purpose and function is to provide warmth, cleanliness and a sense of security to the patient at rest. The welfare of the patient who is affected by his or her surrounding aesthetic would benefit from a visually appealing design in this invention.

As it regards the caregiver and institution who manages the patient and the facility environment, the primary concerns are to the health and safety of the caregiver and patient and to minimizing expense of cost and effort while maximizing benefit and ease to the caregiver and patient. There is a need for an anti-ligative bed linen system and device that enables a caregiver to provide maximum care of the patient wherein less time and effort is dedicated to managing the bedding so that greater time and effort may be dedicated towards the patient.

U.S. Pat. No. 4,924,543 shows a bed linen sheet design that has an attached top sheet and bottom sheet the point of attachment between the two is at the foot of bed top edge. This patent does not address the issue of the danger of loose blankets and does not address how to safely provide blankets to a patient. In fact, the '543 design does not allow a separate top and bottom sheet set to be placed over an existing top and bottom sheet set.

Another approach, U.S. Pat. No. 7,810,184 shows the top and bottom sheet being attached at the side. This design could be problematic as the elderly or confused individual might try to exit the bed on the seamed side and create a fall hazard. The optimal design is for attachment towards the foot of the bed allowing ease of entry and exit from either side. The '184 design also does not allow for multiple sets to be fitted to the mattress and thus not providing the ability to meet different patients' needs for more warmth.

U.S. Pat. No. 6,108,836 shows a bed sheet top and bottom point of attachment at the bottom edge the inventor explains this feature allows the persons foot to extend pass the mattress, this would be an improvement over U.S. Pat. No. 4,924,543. However, U.S. Pat. No. 6,108,836 does not deal with the problem of placing multiple bed linens of the design on one mattress and does not suggest any structures to make a bed linen layerable, especially a bed linen that incorporates a blanket.

U.S. Patent Application No. 2001/0032358 shows a bed linen assembly comprising a fitted sheet, a flat sheet and a comforter, attached at three sides with one opening side to allow the user to enter and exit through. The fitted sheet is designed to fit around a mattress. This invention by design creates a level of difficult for the user and caregiver in terms of limited space and restriction of movement. The device poses difficulty for the caregiver to access the patient resting within the device. In case the patient should have to be removed from the bed, the caregiver must contend with removal of the entire bed linen system of this invention, which is wrapped around the patient on all 3 sides. If the patient should request additional layers of comforter for warmth, there is no safe way off adding more layers internally within this pocket style device without risk of suffocation or restriction of movement. Adding layers over top this device would result in risk of enabling the user to create a lanyard device there from.

U.S. Pat. No. 4,924,543 shows a bed linen system comprising a first fitted cover sheet positioned under a second cover sheet and a third independent sheet attached underneath the first fitted cover sheet by a Velcro type attachment meas. The first two sheets are connected at their bottom ends where the user's feet would abut against when in use. This device is inherently limiting by design wherein the point of attachment between the first two sheets are located at the edge of the top surface of the mattress, restricting movement if the user's foot extends beyond the length of the mattress. If additional layers of linen is required, said linen would have be laid over top, defeating the purpose of this patent which is to avoid loosely laying sheets. The fact that an attached comforter is not contemplated in this claimed design renders it inadequate in addressing the concerns provided above. Without the ability to layer anti-ligative bed linen assemblies, the user would have to resort back to unsafe methods of adding loose layers of sheets and blankets. The risk of enabling the patient to create a lanyard from loose sheets and bedding remains unremedied in this scenario.

Therefore, there is a need for a one-piece bed linen solution that is not easily removed, yet is layerable to address the warmth needs of different patients. Additionally, the bed linen should be made out of thicker, tear resistant fabrics, such as quilted materials, that are difficult to convert into a lethal lanyard. Also, a bed linen system is needed that alerts staff when a patient is attempting to remove the bed linen from a mattress. Furthermore, such a bed linen system would avoid using pillow cases that can be easily converted to deadly objects. Additionally, the bed linen system needs to be easily washed to be hygienic for numerous uses by numerous people. The present invention accomplishes these objectives.

SUMMARY OF THE INVENTION

Figure 1:
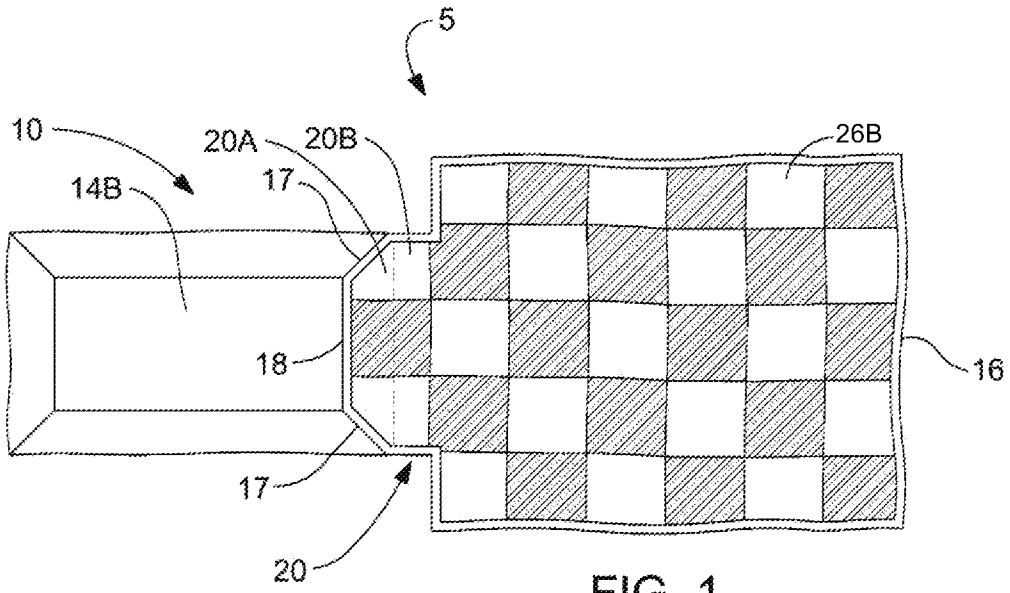
FIG. 1 is a top plan view of an anti-ligative bed linen topside.

The invention herein provides a solution to the problems and concerns raised above. What is claimed is an anti-ligative bed linen system comprising one or more bed linen units, each bed linen unit being constructed in a safe manner to prevent use as lanyard material. The invention is further dually fitted and nestable by design such that safety is preserved while enabling the user or caregiver to add layers to the system with ease of mind and effort.

The invention herein provides many benefits: ease of bed making, comfort, flexibility to safely have more than one blanket, and added aesthetic to the living environment. The bed linen system includes one or more bed linen units. Each bed linen unit comprising at least one blanket and one cover sheet. Said blanket is preferably made from thicker material that is difficult to disengage, such as quilted material. The cover sheet is preferably a thinner sheet intended to cover the mattress and to provide comfort for rest. The cover is preferably fitted directly over the mattress whereas the blanket portion covers the person laying on top of said cover and mattress. The invention herein further pertains to the blanket and cover connected at their relative ends at one or more points of union. The length of the cover and blanket should be great enough to wrap around the entire mattress and to enable the point of union between said cover and blanket to be tucked underneath the mattress by a certain distance to allow additional bed linen units to be nested securely within the prior. The union of the plurality of individual bed linen units should be tandemly positioned in nested position to form a plurality of nested unions. The plurality of nested unions should further be tucked underneath the blanket by a sufficient distance to hold the plurality of bed linen units in place when a person is resting within on said mattress. The location of said union on said bed linen unit defines the way in which the user interacts with the device and system. Ultimately, the purpose of this device and system is to minimize and avoid the formation of a lanyard. As such, the location o the union and the type of material used are important to the anti-ligative features of this invention. Comfort and ease are further another consideration of this invention. The user and caregiver must be able to interact with this system as one would in ordinary circumstances, but in a safer and ergonomically easier manner. The union feature lessens the amount of handling involved when dealing with bed linen. The ability to tuck and nest the bed linen unit further allows a user to easily layer multiple blankets and sheets with minimal effort while achieving a quick finished aesthetic. The nesting feature and choice of location for the union allows the user to rest within in an unrestricted manner. It also provides an easy access circumstance for the caregiver, who has to contend less with blankets and bed sheets while tending to the user. The caregiver simply pushes the blankets aside towards the end where the union is located at, exposing a substantial portion of the user's body, and accessing the user for the necessary care. The bed linen may be removed and cleaned in units, making a more efficient and organized housekeeping system. In addition, the bed linen system of this invention may be equipped with an alarm system, which activates if the bed linen device is removed. Tampering would trigger a response to hospital staff.

From an aesthetic perspective, each bed linen may include a structure that allows a main portion of the blanket to overhang the sides of the mattress in an appealing way. The blanket may drape over side of the mattress in an aesthetically pleasing manner by pleated means, stylized edging (curved, angled or straight edges or combinations thereof), means that allow tucking along particular sides of the mattress, etc. The manner of aesthetic construction is not limited to the examples listed herein. The inherent feature and design of this invention allows for a wide variety of aesthetics to be created. The ability to create a variety of aesthetics that purposefully mimics standard features in the art helps to enhance rehabilitation of the user. If the bed linen system looks good, is easy to manage, and is safe for use, then the burden of care is outweighed by its benefits and appeal.

The bed linen system includes a bi-fold pillow made from thicker fabrics, such as a quilted material. The bi-fold design compartmentalizes stuffing into smaller sections thereby stabilizing the pillow stuffing. The stuffing resists clumping, which can occur when laundering the pillow. The quilted pillow eliminates the asphyxiation hazard associated with vinyl pillows and eliminates the danger of a pillowcase being used as a ligature for suicide. In addition, the use of thicker fabrics and quilted fabric makes the bed linens tamper resistant and tear resistant.

There are a number of advantages to this invention. The primary advantage is the elimination of hazard often observed with standard bed linen products. The combination of thick tear resistant material, elimination of separate pillow devices, and large awkward shape of the device itself makes it difficult to create a lanyard or cause asphyxiation. A second advantage is in the ability to maintain this level of safety and ease of care even when additional bed linen units are layered and nested within. A third advantage is in the ability to securely position a plurality of nested bed linen units in place by their unions. Locating the plurality of tandemly positioned unions of the plurality of bed linen units underneath the mattress for a given distance truly allows a secure and comfortable system that is easy to attach and remove. A fourth advantage is the amount of space available to the user to stretch within the device and system when in use. A fifth advantage is ease and amount of access a caregiver has to the user laying within. The caregiver need not contend with a confusion of sheets and blankets, since they are preconfigured to move in a given direction. A sixth advantage is with improved organization and efficiency for housekeeping. A seventh advantage of this invention is its inherent construction which enables a variety of aesthetics to be added. Unlike the listed prior art that are limited in design by their own manner of construction, the invention herein is constructed in a manner that provides many avenues of design. Yet another advantage of this invention is in the ability to embed simple technology that serves as an alarm tool for staff and caregiver.

The nesting feature is a key element of the claimed subject matter of this invention. This invention focuses on the ability to nest multiple bed linen units on a mattress while maintaining a secure position on said mattress. These two qualities must be concurrently achieved and maintained so that this bed linen system is comfortable, easy to manage and safe for the user over long periods of time. This objective is enabled by the choice location of union between the cover sheet and blanket and the location where the union is positioned relative to the mattress. Preferably, the union is located along a common edge of the blanket and cover. When placed over the mattress, the point of union should lie underneath the mattress surface by a particular inward distance sufficient to secure the unit onto the mattress. This distance may be as minimal as one inch or greater, but preferably approximately two or more inches underneath and inward towards the center of the mattress bottom surface. The point of union when positioned underneath the mattress should lie furthest inward from the edge of said mattress. An open space is provided there from towards the top surface of the bed between the blanket and the attached bottom cover. The space between said blanket and bottom cover available from the top surface towards the bottom surface, reaching inward by one or more inches, allows an additional bed linen unit to nest therein. Not only may another bed linen unit nest within the first, but both layers of nested bed linen units may concurrently fit over the mattress without interference of the other. The open space should further be sufficient for an individual to comfortably enter and exit the covered bed and for a caregiver to comfortably access the individual resting within. The position of the union of each bed linen unit should be adjacently or tandemly positioned to another when more than one are in nested position. The adjacently positioned union of the plurality of bed linen units underneath the mattress allows the system to securely tuck underneath the bed in consolidated manner and uniformly be secured in place against the weight of the mattress and the user laying on top. In fact, the further the point of union is positioned inward underneath the mattress, the greater the number of bed linen units may be nested within and be securely fashioned against the weight of the mattress and user resting on top. Especially if the material involved is thick quilted material, the position should be greater than 1 inch inward from the bottom edge of the mattress. The size of the bed linen unit should be wide and long enough to enable the device to cover a substantial part of the top surface of the mattress while wrapping around underneath said mattress by a certain distance inward for secure fit. The union may comprise one or more points of connection along one or more sides of the bed linen unit. The points of union preferably should not connect more than half the surface area of the blanket to the more than half the surface area of the cover sheet, otherwise defeating the intended ease and access sought to be achieved.

The union component may comprise a single or a series of connections at any particular end of said bed linen unit. Said union may be achieved by stitch, staple, weld, adhesive, etc. Alternative embodiments of this invention may include a bed linen unit comprising one or more blanket attached one or more cover sheet. In any case, each unit should comprise at least one blanket and at least one cover sheet, attached together at one or more points of union along the edge of said device. Said union should be able to reach underneath the bottom surface of said device and inward by a distance to allow secure positioning and secure nesting of additional bed linen units.

DETAILED DESCRIPTION OF THE INVENTION

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments. The illustrations herein should not be interpreted to limit the scope of invention herein but rather as examples of preferred embodiments of the broader invention. The scope of each claim should be interpreted broadly in favor of the inventor.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 10:
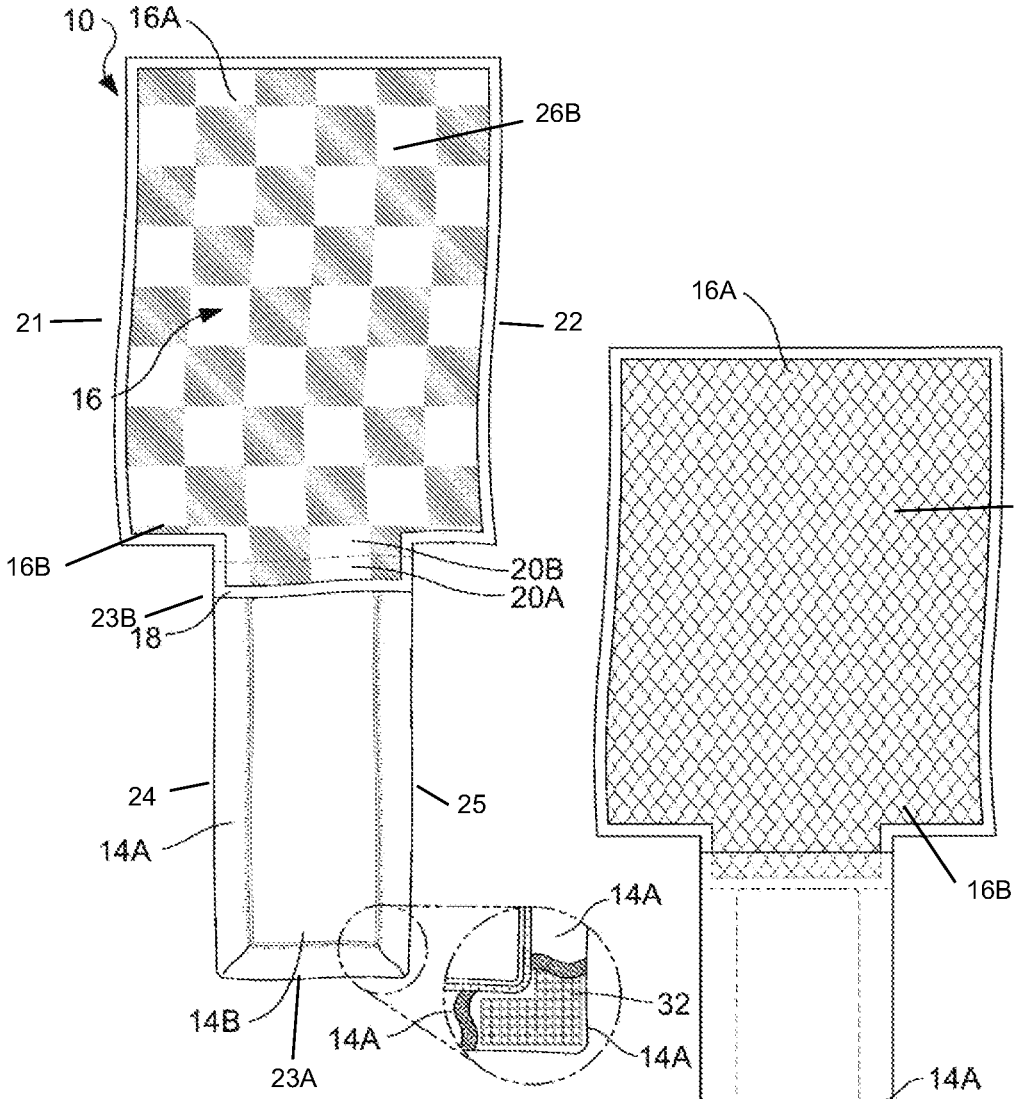
FIG. 10 is a top plan view of a bed linen with an exploded view of sensor material.
Figure 11:
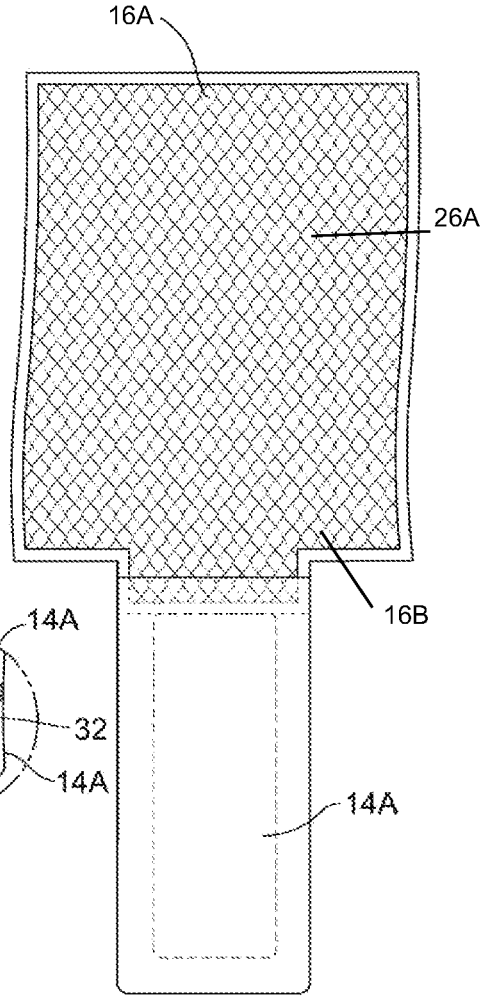
FIG. 11 is a top plan view of an embodiment of a bed linen.
Figure 17:
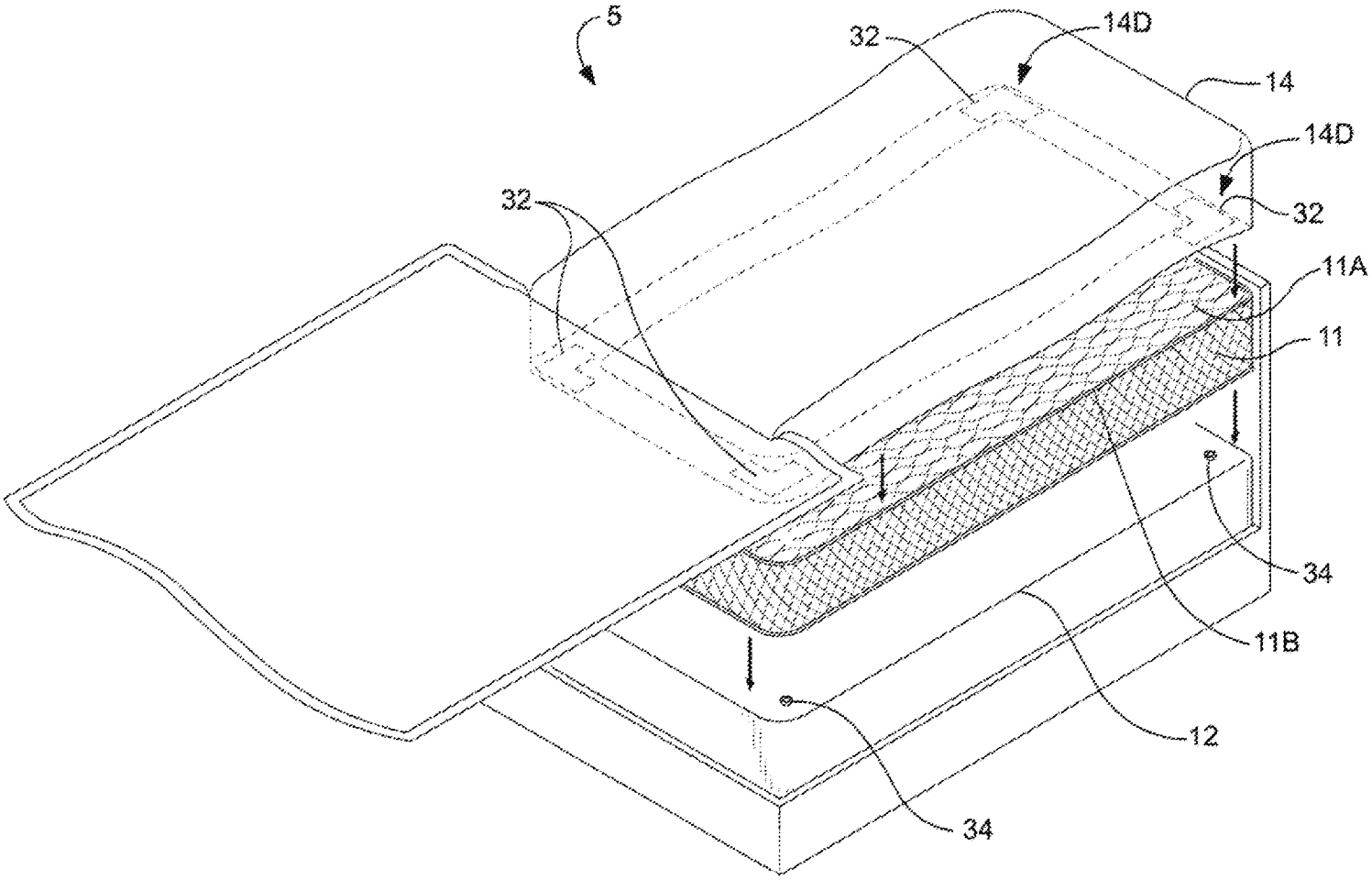
FIG. 17 is a perspective view of the anti-ligative bed linen system.

With respect to the drawings, the invention includes an anti-ligative bed linen system 5 for a mattress 11, as illustrated in FIG. 17. The bed linen system 5 includes a bed linen unit 10, in FIG. 1. In FIGS. 10 and 11, the bed linen unit 10 includes a blanket 16 having a top end 16A, a bottom end 16B, a first side end and a second side end. Said bed linen unit further having a cover having a top end, bottom end, a first and a second side end. Said blanket and cover attached at one or more ends, but preferably at no more than two ends, to form a union at the point of attachment. There may be more than one union located a particular end of attachment of said blanket and cover. Each send end of said blanket and cover terminating at an exposed edge. Each said exposed edge may be straight, curved, angled or combinations thereof. In FIG. 17, a cover 14 is configured to fit on the mattress 11. The cover 14 has an top surface 14A and a bottom surface 14B, as illustrated in FIGS. 10 and 11. The top surface 14A would be facing the external ambient environment away from the mattress surface and the bottom surface 14B would face the mattress 11. The blanket similarly having a bottom surface and a top surface. Said bottom surface of said blanket facing towards the mattress while the top surface of said blanket facing away from the mattress.

Figure 1A:
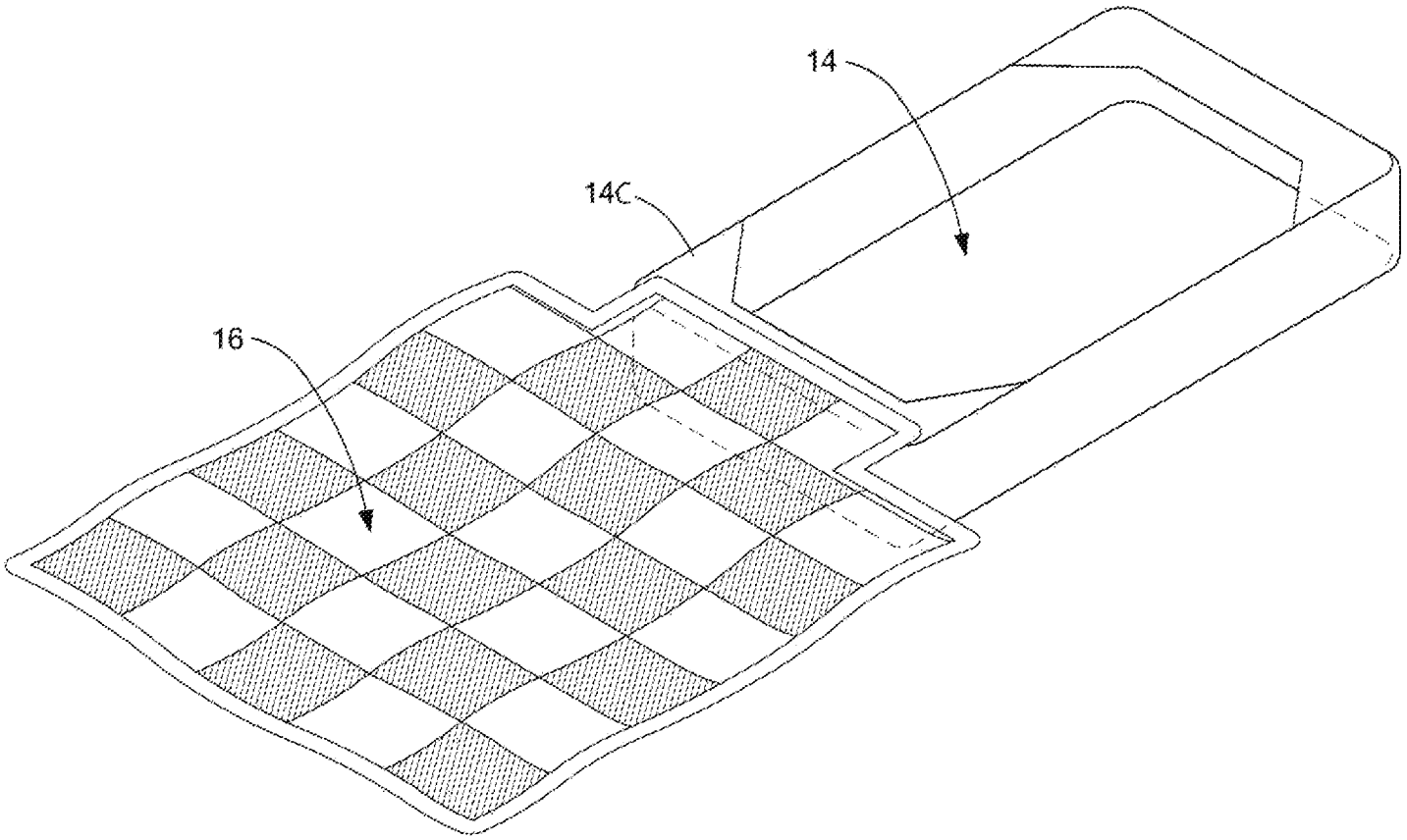
FIG. 1A is a perspective view of an embodiment of a mattress cover.
Figure 1B:
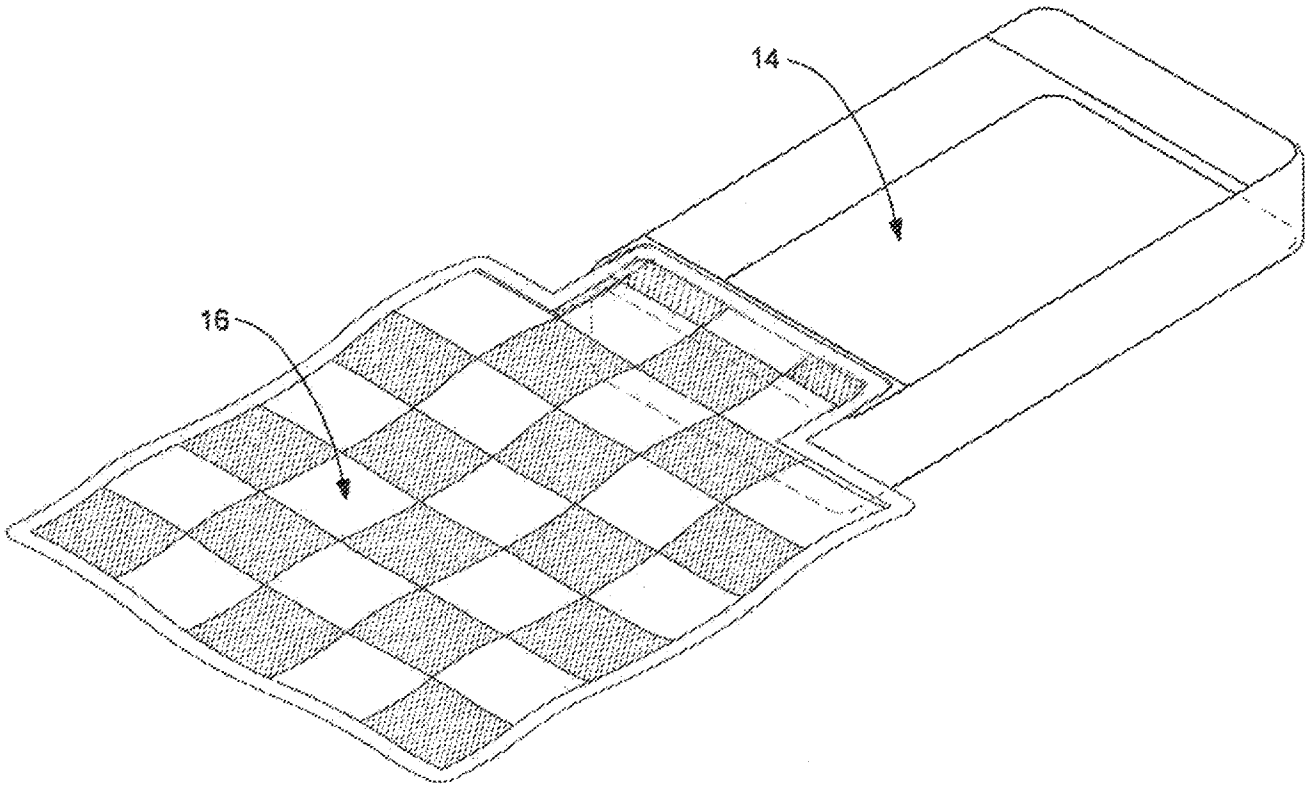
FIG. 1B is a perspective view of another embodiment of a mattress cover.
Figure 3:
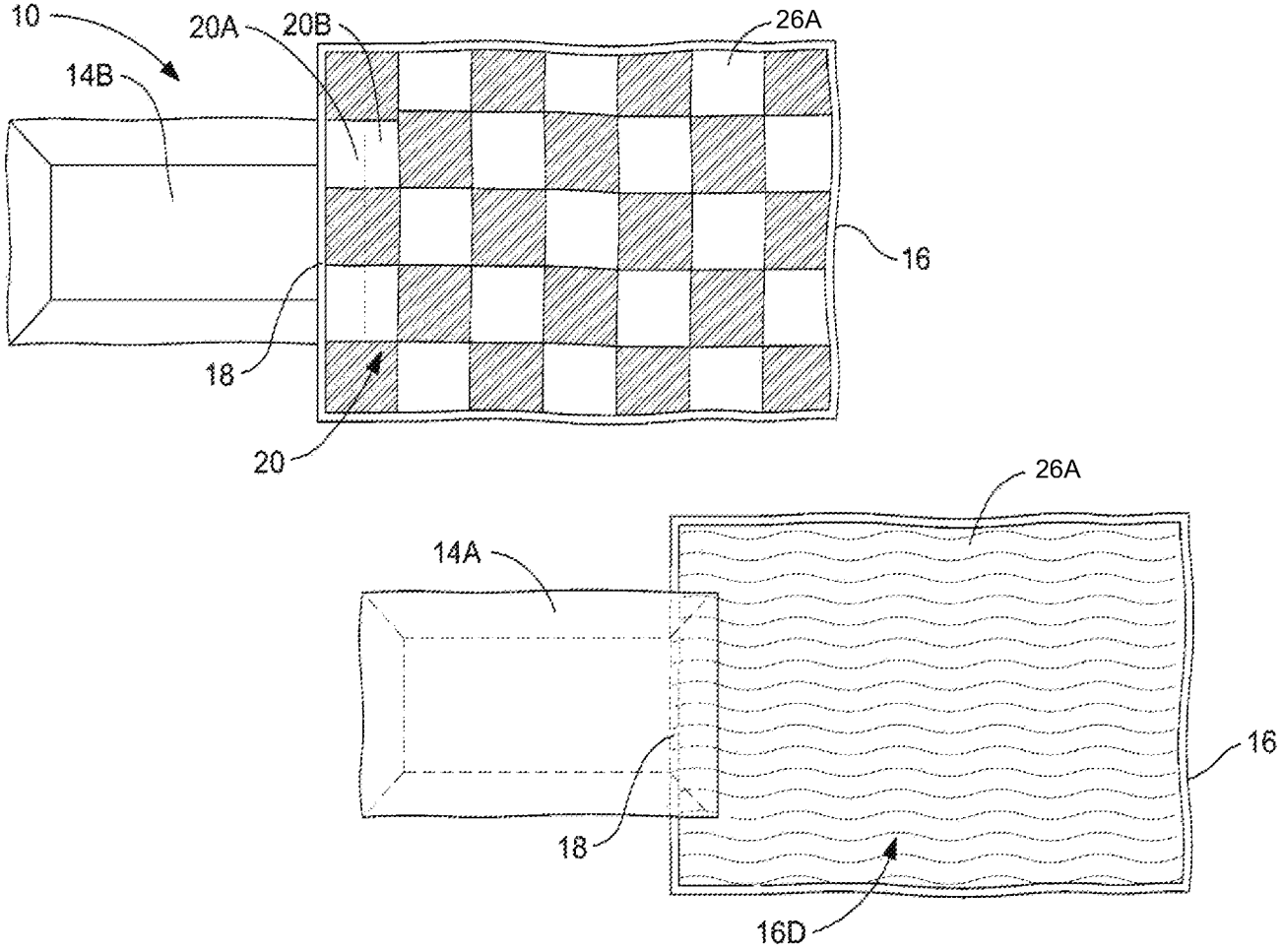
FIG. 3 is a top plan view of an embodiment of the bed linen.
Figure 4:
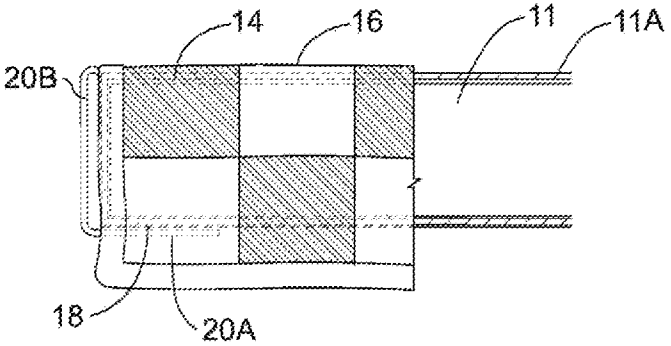
FIG. 4 is a partial side elevational view of the bed linen on a mattress.

In FIG. 3, a lower portion 16C of the bottom surface 16B of the blanket 16 is secured to a lower portion 14C of the top side surface 14A of the cover 14 creating a secured union 18 between the blanket 16 and cover 14 at the bottom end. In a preferred embodiment, the union located towards the bottom end 14C is configured to wrap under the mattress 11, securely positioning the cover 14 onto the mattress 11. FIGS. 1A and 1B illustrate different embodiments of the end portion 14C. In a preferred embodiment, the cover 14 is configured to wrap under all sides of the mattress 11. In FIG. 4, the union 18 is configured to lie under the mattress 11 when the bed linen 10 is placed on the mattress 11. In one embodiment, the cover 14 wraps under the mattress 11 about six inches deep to better secure the cover 14 and so that the union 18 can be place farther under the mattress 11 to provide space for additional bed linens 10 to be added. In one embodiment, the union 18 is created with the stitching running the width of union 18, or partial width, although other securing methods could be used such as hard plastic rivets, or a combination of securing methods could be used. In FIG. 3, a main portion 16D of the blanket 16 is not secured to the cover 14 and is available to be used for warmth when the anti-ligative bed linen system 5 is placed on the mattress 11.

Figure 2:
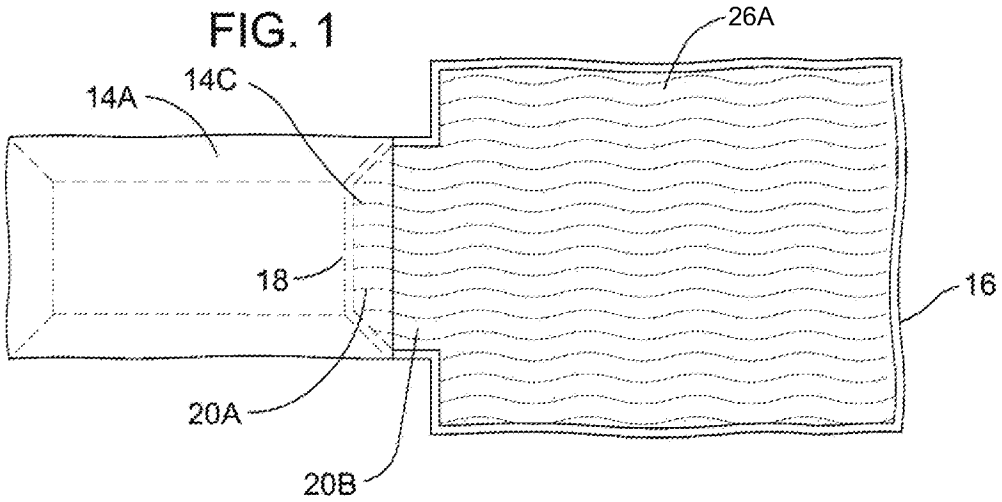
FIG. 2 is a top plan view of an anti-ligative bed linen bottom side.
Figure 5:
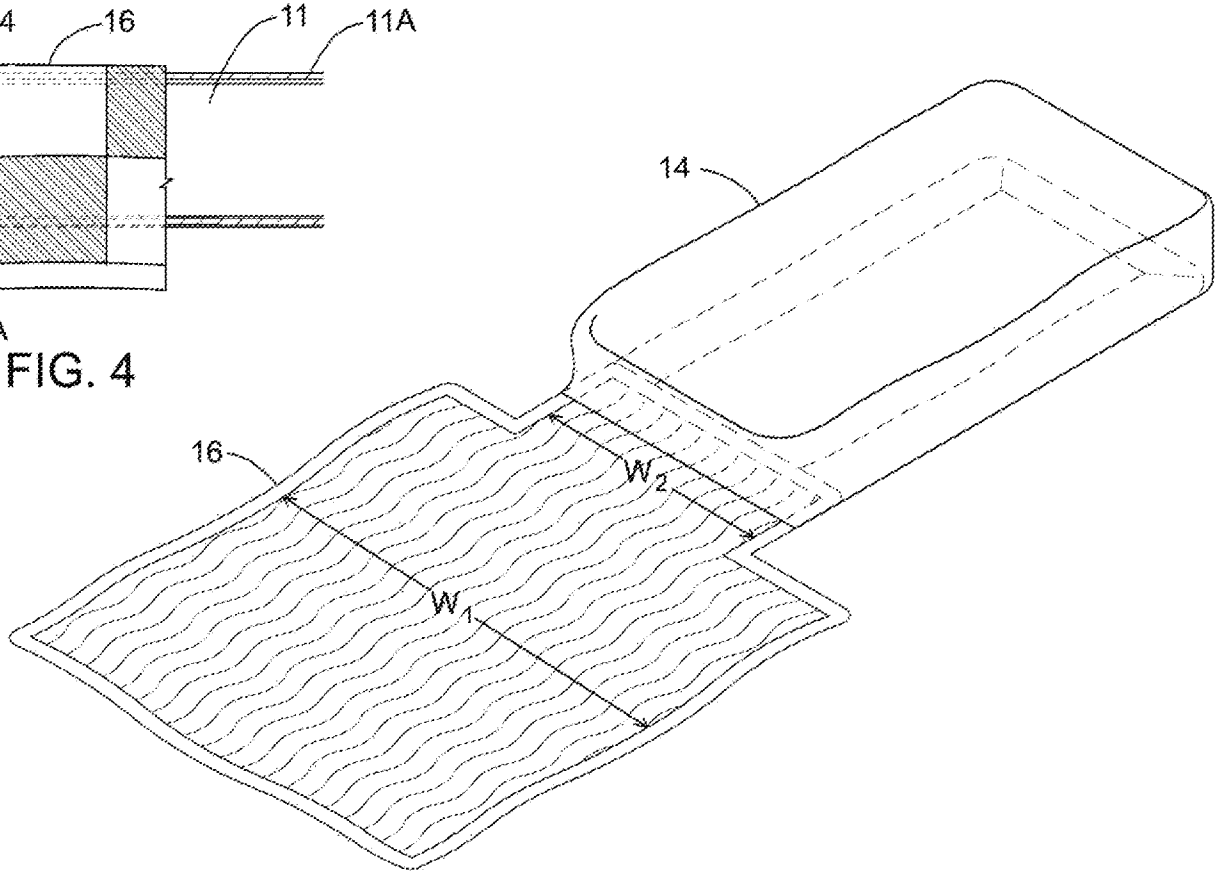
FIG. 5 is a perspective view of an extended flap.

To achieve a pleasing aesthetic, in one embodiment, the lower portion 16C of the blanket 16 includes an extended flap 20 having a width $W_2$ narrower than the width $W_1$ of the main portion 16D of the blanket 16, as illustrated in FIG. 5. In a preferred embodiment the width W2 of the extended flap 20 is approximately the same width as the cover 14 and the mattress 11. In FIG. 2, the edge of 20A of the extended flap 20 is secured between the bottom side surface 16B of the blanket 16 and bottom end of the top surface 14A of the cover 14 creating the secured union 18 between the blanket 16 and cover 14 at the furthest edge of the bottom end. In the embodiment in FIG. 1, I the extended flap 20 has tapered edges 17 and the union 18 length is defined as wholly or partially fixed between each taper 17 of the blanket 16 in one embodiment, the tapered edges 17 are not stitched to the cover 14. In FIGS. 2 and 4, an upper part 20B of the extended flap 20 is not secured to the cover 14 and extends approximately up to a top surface 11A of the mattress 11 when the bed linen 10 is placed on the mattress 11, allowing the main portion 16D of the blanket 16 to drape over side edges 11B of the mattress 11. The combined structure of the blanket 16 easily draping over the mattress 11 and being secured to a fitted or preconfigured cover 14 simplifies the making of a bed by eliminating the need to tuck the corners of sheets or blankets. Less effort is needed to make the bed, which facilitates an unmotivated person to complete a bed making task, in turn improving their sense of confidence and self esteem.

In one embodiment, the bed linen unit 10 is made of a material having a thickness that hinders persons from rolling the bed linen 10 to use as a ligature to commit suicide. In another embodiment, the bed linen unit 10 is made of a material having a strength that hinders persons from tearing the bed linen 10 to use as a ligature to commit suicide. This bed linen system 5 is structured to eliminate the use of loose sheets and be used in place of such sheets. Preferably, the bed linen unit 10 is made of a quilted material, with the quilting strengthening the material. The material is preferably a washable durable material, such as a cotton polyester blend, but other suitable materials with similar properties may be used. A quilted cotton material adds to a person's comfort and the quilted bed linen 10 provides aesthetic and therapeutic value as well. Threads used for the quilting are preferably heavy polyester threads to make the bed linen system 5 tough and resistant to tearing.

Figure 6:
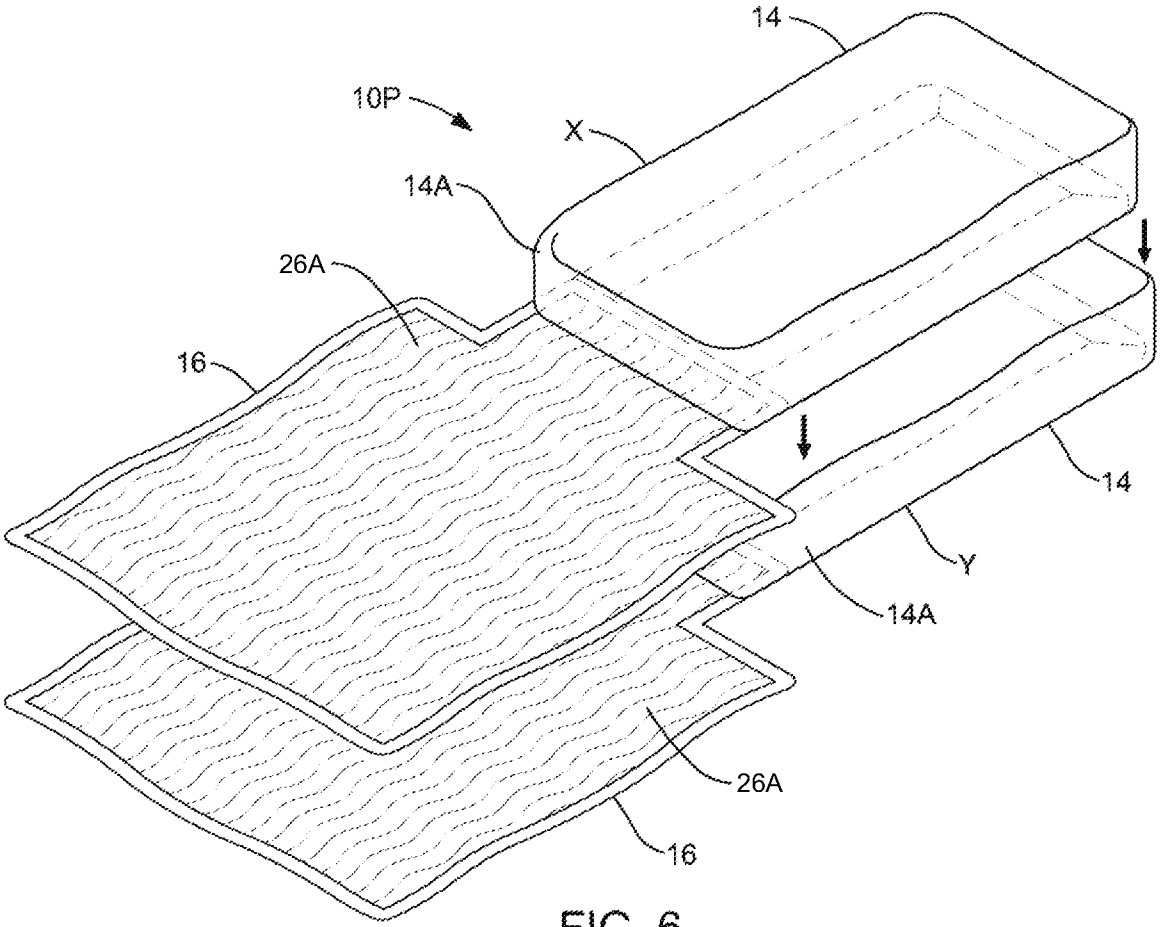
FIG. 6 is a perspective view of a second bed linen X being placed over a first bed linen Y.
Figure 8:
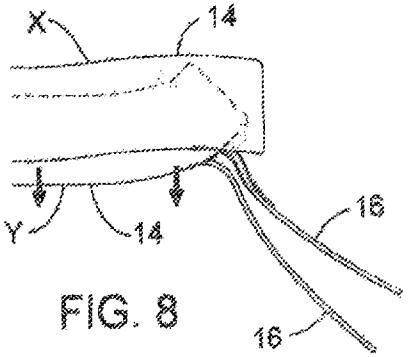
FIG. 8 is a side elevational view of a second bed linen being placed over a first bed linen.
Figure 9:
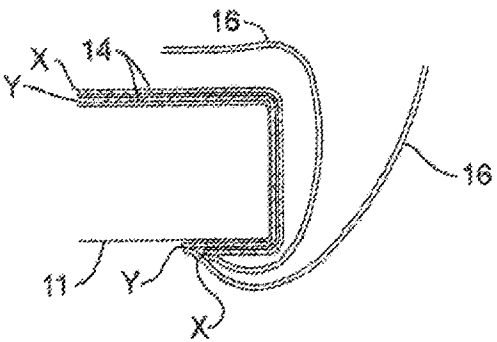
FIG. 9 is a side elevated view of a first bed linen placed over a second bed linen.
Figure 7:
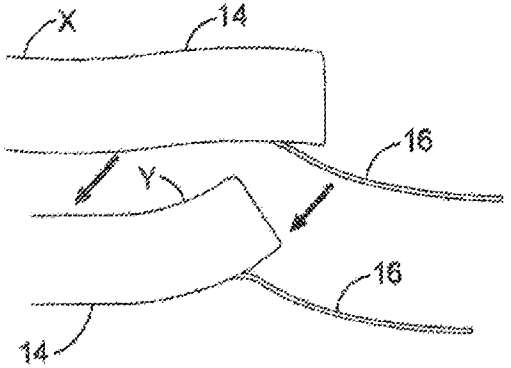
FIG. 7 is a side elevated view of a second bed linen ready to be placed over a first bed linen.

In one embodiment in FIG. 6, the union 18 is configured to lie under the mattress 11 allowing a plurality 10P of bed linens 10 to be placed onto the mattress 11. This embodiment provides the ability to safely place more than one bed linen 10 on the mattress 11 to provide additional warmth from additional blankets 16. In FIGS. 7 and 17, a bed linen Y is first placed on a mattress 11. Next, in FIG. 8, bed linen X is positioned over bed linen Y. This results with bed linens X and Y being placed together on a mattress in nested position, as illustrated in FIG. 9. Bed linen X's blanket 16 and bed linen Y's blanket 16 are available to be positioned on the top of the mattress in nested fashion 11 as desired.

Figure 12:
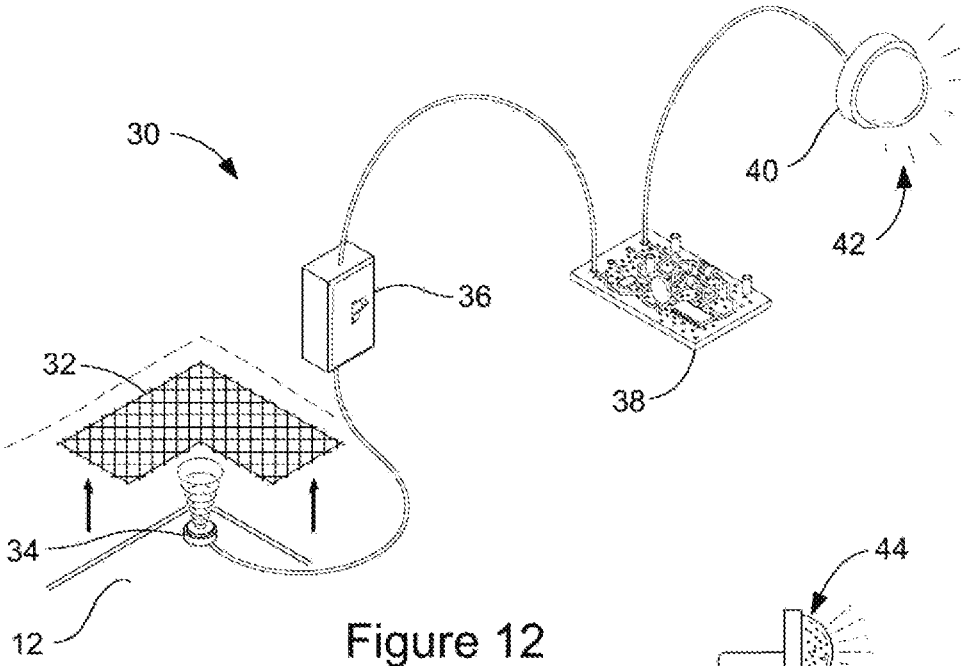
FIG. 12 is a perspective view of an alarm system being actuated.
Figure 13:
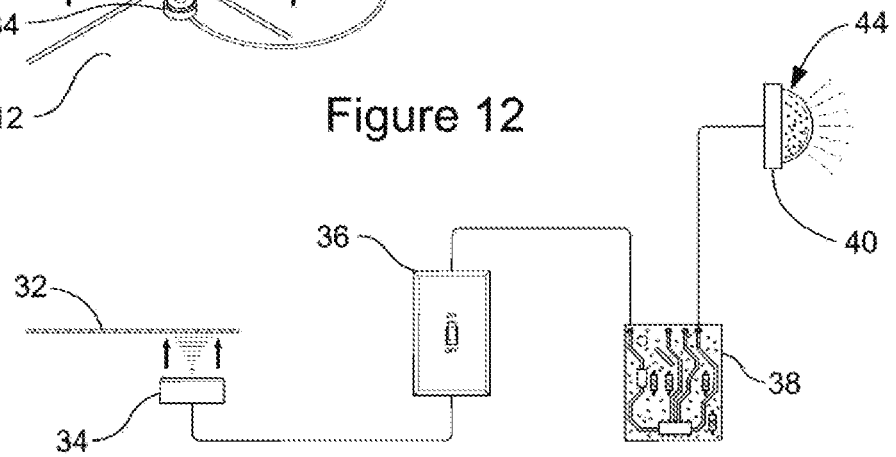
FIG. 13 is a schematic view of an alarm system being actuated.
Figure 14:
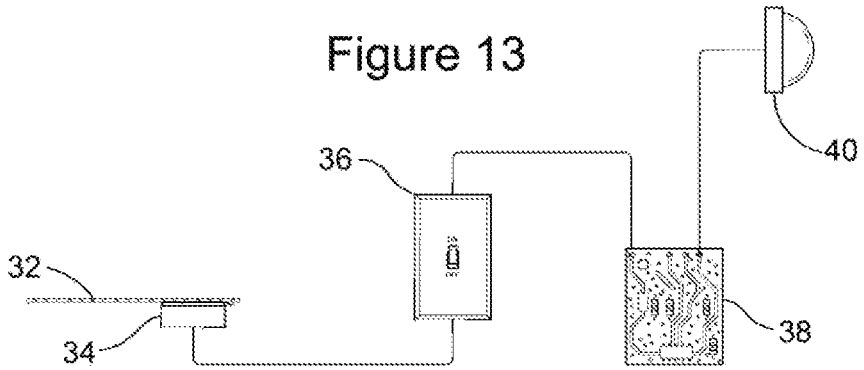
FIG. 14 is a schematic view of an alarm system in a ready state.
Figure 15:
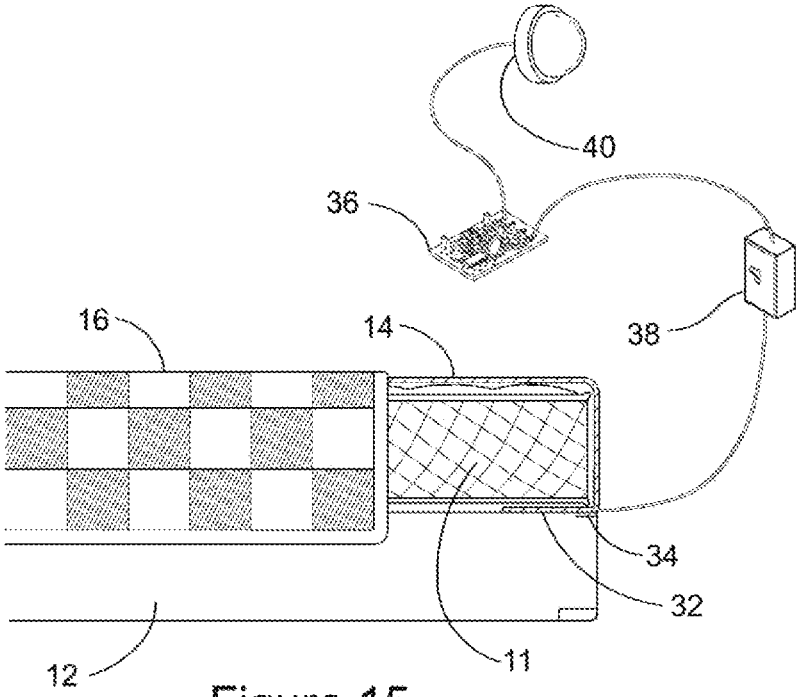
FIG. 15 is a side perspective view of the alarm system in a ready state.
Figure 16:
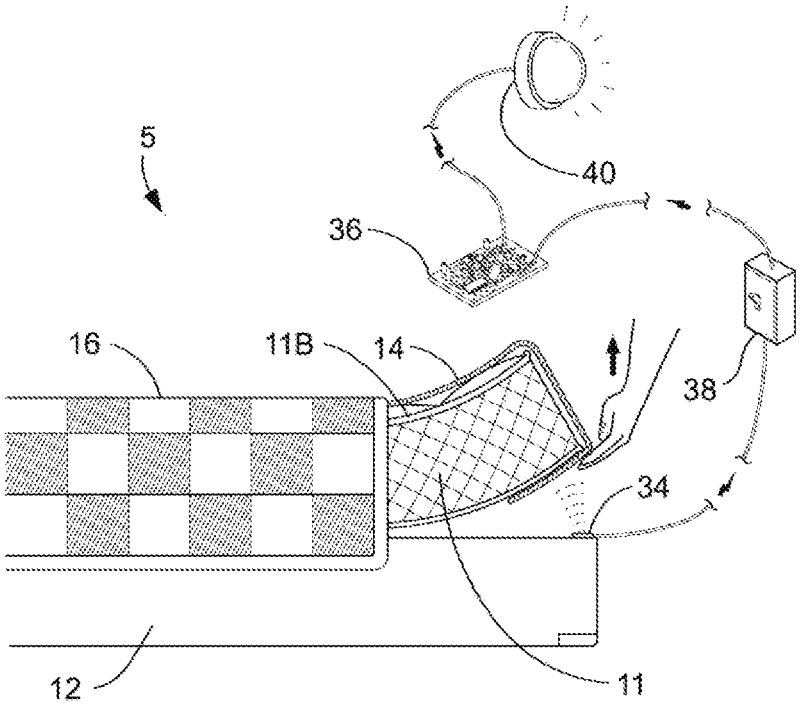
FIG. 16 is a side perspective view of the alarm system being actuated.

One embodiment of the bed linen system 5 further includes an alarm system 30 (FIG. 12) that warns when the bed linen 10 has been removed from the mattress 11. In an embodiment in FIG. 17, the alarm system 30 includes a first sensor piece 32 (may be either sensor emitting or sensor receiving) incorporated into at least one section 14D of the cover 14. The first sensor material 32 may be sewed into the cover 14. In FIGS. 15 and 16, a second sensor piece 34 (either sensor emitting or receiving) is placed proximate to the mattress 11 and recognizes proximity of the first sensor piece 32. In FIGS. 13 and 14, a circuit 38 is in communication with the second sensor piece 34. Also in FIGS. 13 and 14, an alarm 40 is in communication with the circuit 38. As illustrated in FIGS. 12 and 13, the circuit 38 actuates the alarm 40 when the second sensor piece 34 indicates to the circuit 38 that the first sensor piece 32 is no longer in close proximity, indicating the bed linen 10 is being removed from the mattress 11. The term "in communication with" includes both wired and wireless forms of communication, such as traditional metal wiring or wireless communications suitable for use with alarm systems. Any use of wires needs to be securely incorporated to avoid being used as a lanyard as well. As the alarm system 30 is used in close proximity to a sleeping person, care must be taken that the alarm system 30 possesses no risk of fire.

One embodiment of the alarm system 30 further includes a setting switch 36 (FIG. 12) in communication with the circuit 38. The setting switch 36 activates and deactivates the alarm system 30. In one embodiment, the alarm 40 includes a visual warning indicator 42, as seen in FIG. 12. In another embodiment in FIG. 13, the alarm 40 includes an audio warning indicator 44. The alarm 40 may include both the visual and audio warning indicators 42, 44 to better alert the appropriate people that the bed linen 10 is being removed from the mattress 11 and a person may be attempting to harm themselves.

In the embodiment of FIG. 17, the second sensor piece 34 of the cover 14 is configured to be located under the mattress 11 when the cover 14 is placed on the mattress 11. Another embodiment of FIG. 17 provides a second sensor piece 34 attached to a bed platform 12 located underneath the mattress 11. The first or second sensor pieces 32, 34 may be a metalized material, such as a soft flexible metal mesh type material that can be reliably detected by a sensor piece of the first or second type, 32, 34 although other suitable material may be used. Either first or second sensor pieces 32, 34 must be washable and have buffering features to minimize risk of tear into the bed linen unit 10.

Figure 18A:
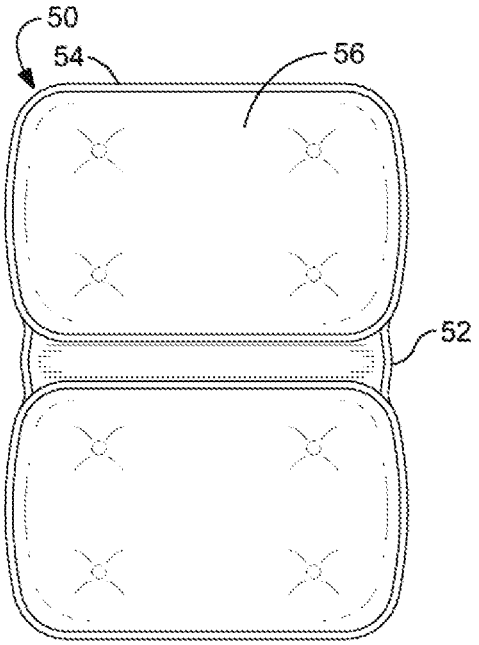
FIG. 18A is a top plan view of a bi-fold pillow in an unfolded state.
Figure 18B:
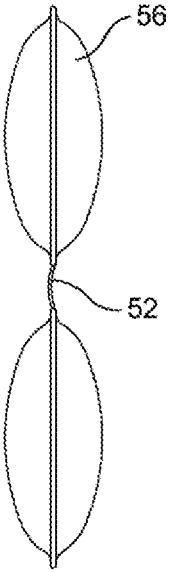
FIG. 18B is a side elevational view of a bi-fold pillow.
Figure 19:
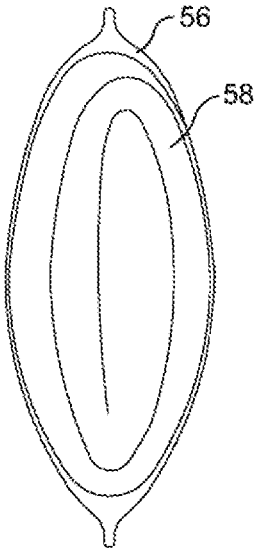
FIG. 19 is a cross-sectional view of a pillow half, illustrating lofty stuffing.
Figure 18C:
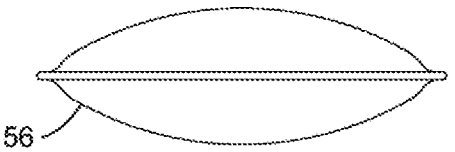
FIG. 18C is a front elevational view of a bi-fold pillow.
Figure 20:
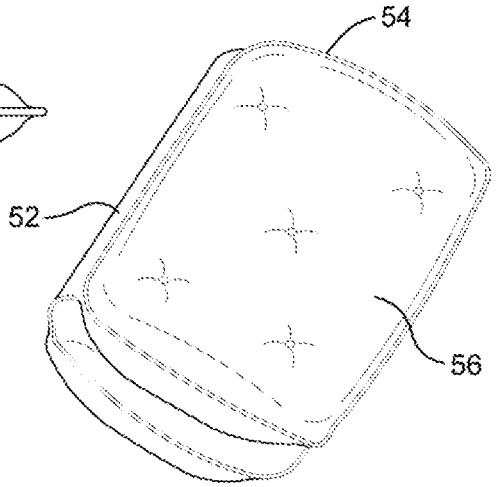
FIG. 20 is a perspective view of a bi-fold

In FIG. 18A, another embodiment of the bed linen system 5 further includes a washable bi-fold quilted pillow 50. As the entire pillow 50 is washable, the pillow 50 does not need a pillowcase. Additionally, as the pillow 50 is quilted, the pillow 50 is difficult to tear open to use for suffocation. The bi-fold pillow 50 shown in FIGS. 18A-18C includes two pillow halves 56 that are hinged together with a strip of fabric 52, in FIG. 18B. In FIG. 19, each pillow half 56 has lofty stuffing 58 that is not typical of pillow stuffing. The lofty stuffing 58 is typically used in blankets and is rolled up and stuffed into each half 56, as illustrated in FIG. 19. The two pillow halves 56 create a clumping resistant stuffing that will stand up to numerous washings. In FIG. 20, each pillow 50 includes a tacking 54 to further prevent clumping by stabilizing the lofty stuffing within the pillow 50. The bi-fold pillow 50 provides a pillow 50 that has compartmentalized the lofty stuffing 58 thus giving the lofty stuffing 58 a stabilizing property that will resist clumping when laundered, yet be thin enough to fit in most standard size washing machines. Folding the two halves 56 together creates a pillow 50 that is the thickness of typical pillows. One use of the bi-fold pillow 50 could be in psychiatric institutions that require frequent washings of pillows for infection control. This bi-fold pillow 50 would be a replacement to typical vinyl covered pillows found in hospitals and institutions. Vinyl covered pillows have been used by psychiatric patients for self-harm by asphyxiation, by creating an opening and wrapping the vinyl covering over their head.

Figure 21:
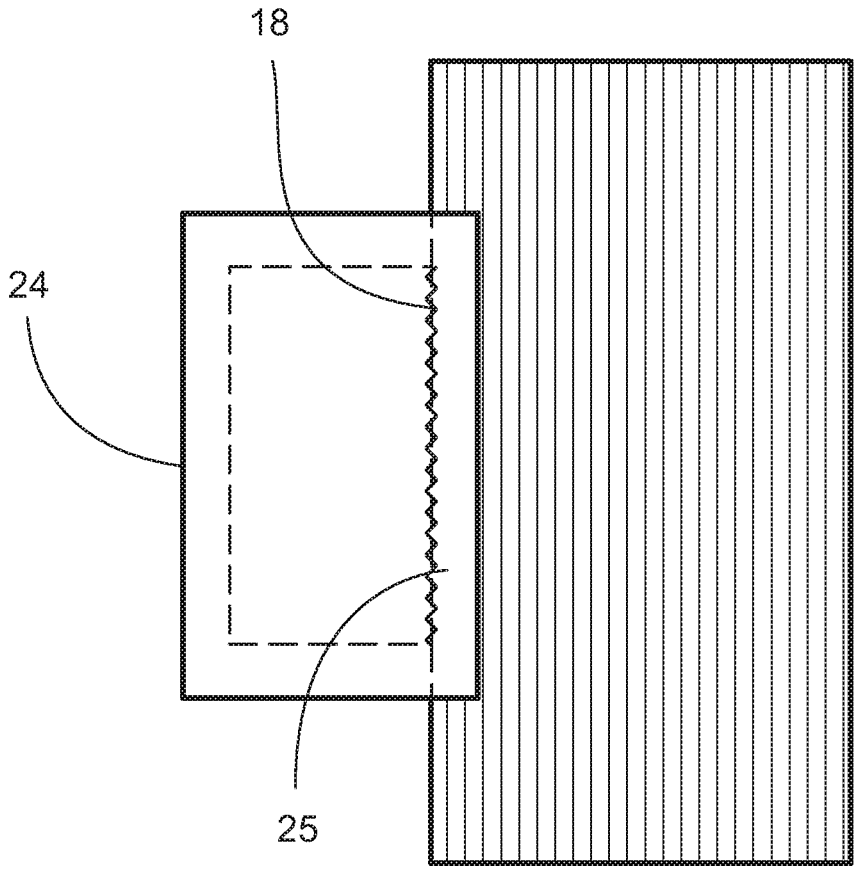
FIG. 21 is a top perspective view of the invention herein according to a preferred alternative embodiment.

Additional illustration is provided according to FIG. 21 wherein the point of union is located at either first or second end of said bed linen unit. This alternative embodiment may be preferable for institutions where mattresses are aligned alongside a wall wherein the user would be limited to enter from top, bottom or a side end of the mattress. The union being located at either the first or second end of the bed linen unit allows the user to flip the blanket upward from a side end rather than from the bottom end. FIG. 22 provides yet another embodiment wherein said union is located at two locations, a top end and a second side end, of said bed linen unit in an "L" shaped connected form. In this manner, the user or patient enters and exits said bed linen unit and system through an open top and first side end with ease and with sufficient room for movement. The unions being located at two ends of the device enables greater security of the system on the mattress and creates greater difficulty for forming a lanyard when the device is in extended form. For any single bed linen unit, at least one cover is attached to at least one blanket wherein, no matter the number of attached linen, a space is provided between the blanket and the cover from the point union to allow nesting of additional bed linen units and tucking of the plurality of nested units inward from the bottom edge and surface of the mattress.

The overarching purpose and intent is to provide a comfortable and easy to manage bed linen device and system that simulates a standard bed linen application which includes the ability to enter, exit and layer comfortably and with anti-ligative features that minimizes the ability to form a lanyard. This invention improves on existing systems by minimizing the amount of effort typically expended to manage a bed linen system for institutions that manage individuals with self harming tendencies. The improvement also includes a decreased risk of danger to the user by minimizing the ability of converting a bed linen system into a lanyard. The inherent structure of this device allows aesthetically pleasing features and technology to be easily designed into manufacturing without interfering with the intended construction of the invention. The enabling feature of this device, the nestable union element, does not contradict nor interfere with existing standards or of aesthetics for bed linen systems in the art. This device easily mimics existing ideas and designs for bed linen aesthetics, which helps the user to integrate with social standards and norms. The device herein may be nested while the remaining elements of the bed linen unit and system may still drape over the side in a pleasing manner. Even further, the inherent structure and design of this invention, no matter the particular embodiment, provides sufficient space for the user to exit and enter and for the caregiver to access, simulating the affect of a typical unconnected bed linen system. As such, ease and comfort to the user is improved without compromising safety and welfare of the caregiver by the improved design. Management of such an embodiment of this invention would require no greater effort (but in fact less effort) by the caregiver than the standard existing bed linen systems and devices.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention. Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A nestable anti-ligative bed linen device for a mattress, comprising:

one or more individual bed linen units, each individual bed linen unit comprising a cover and a blanket, said cover having a top end, a bottom end, a first side end, a second side end, a top surface and a bottom surface, said blanket having a top end, a bottom end, a first side end, a second side end, a top surface and a bottom surface, said blanket joined with said cover at any one of said top end, bottom end, first side end, or second side end of their each respective sides between said top surface of said cover and said bottom surface of said blanket, a main portion of said blanket is not joined to said cover, each said individual bed linen unit comprising material having a thickness that hinders persons from tearing or rolling said material into a ligature, said blanket and said cover having a dimension greater than the dimension of said mattress such that said individual bed linen unit drapes over said mattress, said location of joinder between said blanket and said cover tuckable underneath a bed mattress by at least two or more inches rearward from said mattress edge, each said individual bed linen device nestable between said blanket and said cover of another said individual bed linen device wherein said location of joinder of said blanket and cover of each said individual bed linen device being tandemly positionable.

2. Each said individual bed linen unit of claim 1 comprising one or more cover joined to one or more blanket.

3. Said nestable anti-ligative bed linen device of claim 1 wherein each said individual bed linen unit further including a washable bi-fold quilted pillow joined to said cover at said top surface of said top end of said cover.

4. Said nestable anti-ligative bed linen device of claim 1 wherein each said individual bed linen unit further comprising an alarm attached to said cover, said alarm comprising a sensory element sensitive to the removal of said cover from said mattress.

5. Said nestable anti-ligative bed linen device of claim 4 wherein said alarm includes:

a circuit element in communication with said sensor element and an alarm element in communication with said circuit element, said sensor element attached to said cover of said individual bed linen unit, whereby said alarm is actuated by shifting said sensor element away from said circuit when said cover of said individual bed linen unit is being removed from said mattress.

6. Said nestable anti-ligative bed linen device of claim 5 wherein said circuit element is oppositely positioned from and in direct communication with said sensor element underneath said mattress.

7. Said nestable anti-ligative bed linen device of claim 4 further including a setting switch for activating and deactivating said alarm.

8. Said nestable anti-ligative bed linen device of claim 4 wherein said alarm element includes a visual or audio warning indicator.

9. A nestable anti-ligative bed linen system comprising a plurality of said individual bed linen units as described in claim 1, wherein each individual bed linen unit is nestable within another individual bed linen unit to form a plurality of nested individual bed linen units, each said individual bed linen unit is internally positionable to another said individual bed linen unit and tandemly at their each respective common location of joinder to form a plurality of nested individual bed linen units concurrently drapable over and tuckable underneath a mattress by at least two inches rearward from said mattress edge.

10. Said nestable anti-ligative bed linen system of claim 9 further being sensitive to removal of said cover from said mattress by affect of a motion sensor alarm attached between said cover and said mattress.

* * * * *